United States Patent [19]

Rath

[11] 4,083,525

[45] Apr. 11, 1978

[54] FASTENER FOR HANGING PICTURES

[76] Inventor: Richard W. Rath, 94 Winslow Ct. #3, Campbell, Calif. 95008

[21] Appl. No.: 729,668

[22] Filed: Oct. 5, 1976

[51] Int. Cl.[2] ..... A47G 1/24

[52] U.S. Cl. ..... 248/496; 248/224.4; 248/477

[58] Field of Search ..... 248/495, 496, 497, 489, 248/477, 476, 467, 294, 221.4, 221.3, 225.2, 220.2, 206 A, 224.4; 24/225, 226, 201 HH

[56] References Cited

U.S. PATENT DOCUMENTS

| | | | |
|---|---|---|---|
| 2,299,443 | 10/1942 | Walmsley | 248/497 |
| 3,294,355 | 12/1966 | Topf | 248/489 X |
| 3,529,799 | 9/1970 | Schaefer | 248/496 |
| 3,848,843 | 11/1974 | Levy | 248/496 X |

*Primary Examiner*—Roy D. Frazier
*Assistant Examiner*—Rodney H. Bonck
*Attorney, Agent, or Firm*—Gerald L. Moore

[57] ABSTRACT

A picture hanging bracket comprising a pair of complementary parts, one for attachment to the picture and the other for attachment to the wall, which parts interact to hold the picture and also to permit leveling after the picture is hung on the wall.

1 Claim, 5 Drawing Figures

FASTENER FOR HANGING PICTURES

BACKGROUND OF THE INVENTION

In hanging pictures and other objects on the wall, it is preferable not to use nails because upon removal, holes are left in the walls which are unsightly and must be repaired. Thus there have evolved brackets of the type which glue onto the wall and onto the picture if necessary. However, such brackets are usually difficult to place on the picture and on the wall such that the picture hangs at a level attitude.

It is the general object of this invention to provide an improved bracket for hanging objects on the wall which bracket permits the alignment of the object and once aligned, firmly holds the object in that attitude.

SUMMARY OF THE INVENTION

A fastener for attaching objects to the wall comprising first and second parts, each part including a backing plate for attachment to the corresponding wall or picture and including a post extending at an acute angle to the backing plate, each part including a recess for receiving the post of the other part such that said members interfit with the first member being inverted relative to the second member, and surfaces on both parts which abutt and hold one part stationary relative to the other part while permitting adjustment of their relative positions to allow alignment of the hung object.

DESCRIPTION Of THE INVENTION

Figure 1:
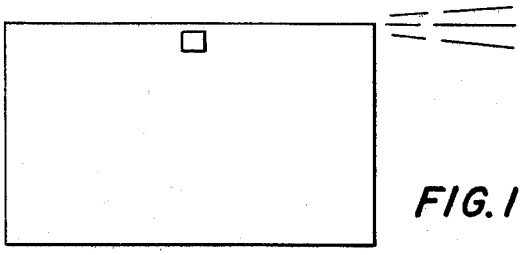
FIG. 1 shows a picture with a part attached for attachment onto a wall.
Figure 2:
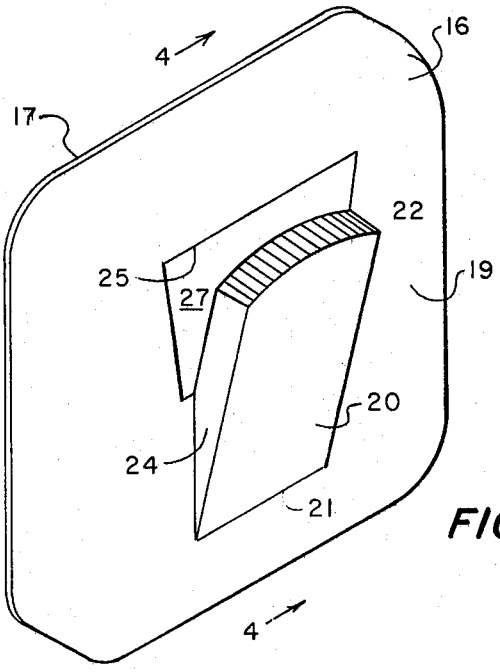
FIG. 2 shows one part of the fastener in an enlarged perspective view.

Shown in FIG. 1, is a fastener 10 attached for the attachment for hanging a picture 11 on a wall. After attachment to the wall, it is sometimes necessary to adjust the attitude of the picture through the angles illustrated by the lines 12 for proper horizontal alignment. However where brackets are glued directly to the picture and the wall, such adjustment has been difficult.

The present invention is shown in FIGS. 2 through 5 and comprises the fastener 10 made of a pair of parts 14 and 15 which are identical and which interfit when one is inverted relative to the other. Each part comprises a base member 16 having a flat surface 17 for attachment to the picture structure or the wall structure. Preferably there is located on this flat surface an adhesive 18 in the form of a layer of sticky material which will adhere to the wall or to the back of an object such as a picture frame.

Extending at an acute angle relative to the plane of the base member of the part and away from the front face 19 is a post 20 preferably formed integrally with the baseplate in a one-piece molded plastic assembly. The post is generally rectangular in cross-section and in this embodiment extends at an angle of approximately 25° to the baseplate. The extending end thereof is formed along a convex arc drawn around the approximate center point of the largest side of the post. This end is also roughened in some manner, preferably by forming serrations 22 thereon extending across the end and generally parallel to the shorter edges 24 and perpendicular to the plane of the post.

The baseplate 16 also includes a recess 25 therein having a cross-section slightly larger than the cross-section of the post 20 and extending parallel thereto preferably in the space between the post and the baseplate. Thus one side of this recess is formed by the extended surface 26 of the post and the other side 27 is the baseplate body. The bottom edge 28 preferably includes serrations and also is of a concave arcuate configuration generally formed with the center of the arc being roughly the center of the adjacent post 22.

Figure 3:
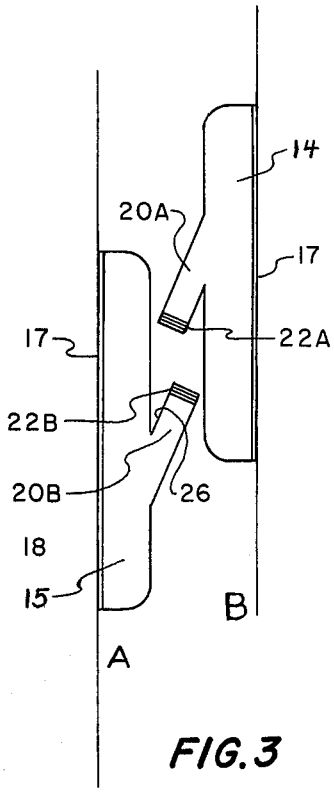
FIG. 3 shows both parts of the fastener in position to be interfitted for hanging an object on the wall.
Figure 4:
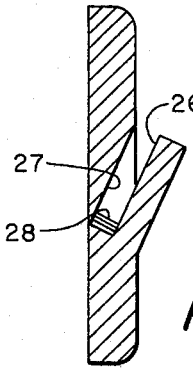
FIG. 4 shows one part of the fastener in cross-section.

Thus to assemble a wall fastener for a picture, a pair of these parts are fitted together as shown in FIG. 3. The part A is fixed to the picture or object to be attached to the wall and the part B is attached to the wall. Attachment is achieved by pressing the adhesive surface 18 against the picture or wall. One part is positioned upside down relative to the other with the part A attached to the picture having the post 20A extending downward. Thereafter the picture is maneuvered until the post 20A is slid into the opening 25 of the part B until the end 22A thereof contacts the bottom of the recess in the part B and the end 22B contacts the bottom of the recess in the part A.

Figure 5:
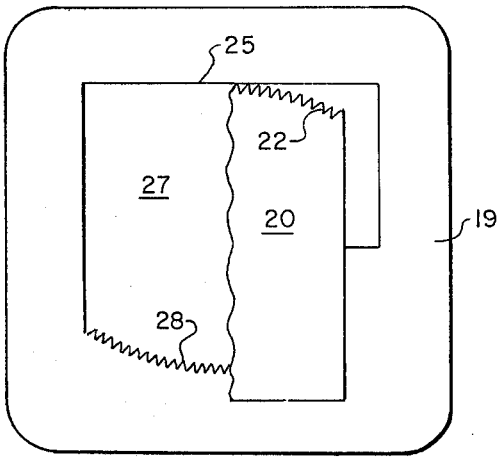
FIG. 5 is a plan view partially cut away of the two parts of the fastener fitted together.

For adjustment of the attitude of the picture after hanging, the picture can be lifted very slightly and tilted to one side or the other with the ends of the posts sliding along the roughened bottom of the recess as shown in FIG. 5. By thereafter lowering the picture back onto the fastener, the roughened end 22 of each part is pressed against the roughened bottom of the receiving recess to hold the picture in the position selected. Thus even though the fasteners might be attached to the wall or picture to initially hold the picture in a non-horizontal attitude, the fastener can be maneuvered so as to straighten up the picture relative to the wall and hold it in that position because of the interlocking surfaces on the parts. Also the adjacent surfaces 26 of the posts can be roughened to assist in holding the parts stationary relative to each other.

It should also be realized that while a preferred embodiment has been described, other means can be used for attaching the units to the wall and the picture such as nails, et cetera. In addition, the units can be made larger or smaller depending upon the weight and size of the object to be attached to the wall. Thus it can be seen that the subject invention provides an improved method of attaching objects to walls and of allowing adjustment of the object after such attachment.

The invention claimed:

1. A fastener for attaching pictures and the like to the wall, comprising in combination:

a first part for atachment to the picture structure;

a second part for attachment to the wall structure;

said first and second parts each including a base member;

means for attaching the base of one part to one structure and the base of the other part to the other structure;

each part including a post extending at an acute angle to the base;

each part also including a recess having a bottom surface which is serrated, each said recess being configured for receiving the post of the other part such that when the part attached to the picture is positioned with the post extending generally downward and the part attached to the wall is positioned with the post extending generally upward, the parts can be interlocked with the post of each part extending into the recess of the other part to hold the picture on the wall; and each extending end of the post being serrated to engage the bottom surface of the recess of the other part and hold the parts at the angle selected relative to each other.

* * * * *